US011339964B2

(12) United States Patent
Daddis et al.

(10) Patent No.: US 11,339,964 B2
(45) Date of Patent: May 24, 2022

(54) INWARD FIRED LOW $NO_X$ PREMIX BURNER

(71) Applicant: Carrier Corporation, Palm Beach Gardens, FL (US)

(72) Inventors: Eugene Duane Daddis, Manlius, NY (US); Fahad Anwar, Avon, IN (US); Colin William Carey, Brownsburg, IN (US); Vance Larell Chapman, Camby, IN (US); Amir Ali Montakhab, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 116 days.

(21) Appl. No.: 16/630,711

(22) PCT Filed: Jul. 13, 2018

(86) PCT No.: PCT/US2018/041997

§ 371 (c)(1),
(2) Date: Jan. 13, 2020

(87) PCT Pub. No.: WO2019/014543

PCT Pub. Date: Jan. 17, 2019

(65) Prior Publication Data

US 2021/0088211 A1 Mar. 25, 2021

Related U.S. Application Data

(60) Provisional application No. 62/532,672, filed on Jul. 14, 2017.

(51) Int. Cl.
*F23D 14/02* (2006.01)
*F23D 14/62* (2006.01)

(52) U.S. Cl.
CPC ..... *F23D 14/02* (2013.01); *F23D 14/62* (2013.01); *F23C 2900/07002* (2013.01); *F23D 2203/1012* (2013.01)

(58) Field of Classification Search
CPC .. F23D 14/02; F23D 14/62; F23D 2203/1012; F23C 2900/07002
(Continued)

(56) References Cited

U.S. PATENT DOCUMENTS 5,346,002 A 9/1994 Swilik, Jr. et al.
5,375,586 A 12/1994 Schumacher et al.
(Continued)

FOREIGN PATENT DOCUMENTS

CN 1229587 C 11/2005
EP 1323991 A2 10/2008

OTHER PUBLICATIONS

PCT International Search Report and Written Opinion for PCT/US2018/041997; dated Feb. 1, 2019; 15 pages.
(Continued)

*Primary Examiner* — Avinash A Savani
(74) *Attorney, Agent, or Firm* — Cantor Colburn LLP

(57) ABSTRACT

A burner assembly for providing a flame and combustion gas to a plurality of inlets includes a burner frame having a channel formed therein. The channel extends parallel to a longitudinal plane defined by the plurality of inlets. A burner is mounted within the channel of the burner frame. The burner is arranged in fluid communication with the plurality of inlets. A burner bracket is used to mount the burner assembly within a burner box. The burner bracket defines a cavity within which the channel of the burner frame and the burner are positionable.

20 Claims, 8 Drawing Sheets

(58) Field of Classification Search
USPC ..... 431/328
See application file for complete search history.

(56) References Cited

U.S. PATENT DOCUMENTS

| | | | |
|---|---|---|---|
| 5,379,751 | A | 1/1995 | Larsen et al. |
| 5,799,646 | A | 9/1998 | Zia et al. |
| 5,899,686 | A | 5/1999 | Carbone et al. |
| 6,758,208 | B2 | 7/2004 | Glerula et al. |
| 6,860,734 | B2 | 3/2005 | Zia |
| 6,889,686 | B2 | 5/2005 | Specht |
| 7,726,386 | B2 | 6/2010 | Specht |
| 8,167,610 | B2 | 5/2012 | Raleigh et al. |
| 8,616,194 | B2 | 12/2013 | Sherrow et al. |
| 8,668,489 | B2 | 3/2014 | Chiappetta et al. |
| 8,919,337 | B2 | 12/2014 | Schultz et al. |
| 8,985,999 | B2 | 3/2015 | Sherrow et al. |
| 9,316,411 | B2 | 4/2016 | Sherrow et al. |
| 9,605,871 | B2 | 3/2017 | Schultz et al. |
| 2009/0044793 | A1 | 2/2009 | Khan et al. |
| 2012/0178031 | A1 | 7/2012 | Roy |
| 2012/0240917 | A1* | 9/2012 | Tolleneer ..... F23D 14/84 126/116 R |
| 2013/0213379 | A1 | 8/2013 | Schultz et al. |
| 2013/0252185 | A1 | 9/2013 | Shaw et al. |
| 2014/0020669 | A1 | 1/2014 | Sherrow et al. |
| 2015/0369495 | A1 | 12/2015 | Maricic et al. |
| 2016/0040905 | A1 | 2/2016 | Shellenberger et al. |
| 2016/0178236 | A1 | 6/2016 | Garloch et al. |
| 2016/0290679 | A1 | 10/2016 | Shaw et al. |
| 2017/0241666 | A1* | 8/2017 | Kowald ..... F24H 9/1881 |

OTHER PUBLICATIONS

PCT Invitation to Pay Additional Fees and, Where Applicable, Protest Fee for Application No. PCT/US2018/041997; dated Oct. 29, 2018; 10 pages.

* cited by examiner

INWARD FIRED LOW $NO_X$ PREMIX BURNER

CROSS-REFERENCE TO RELATED APPLICATIONS

This application is a 371 U.S. National Stage application of PCT/US2018/041997, filed Jul. 13, 2018, which claims the benefit of U.S. Provisional Application No. 62/532,672, filed Jul. 14, 2017, both of which are incorporated by reference in their entirety herein.

BACKGROUND

The subject matter disclosed herein relates to heating systems. More specifically, the subject disclosure relates to burners for residential and commercial heating systems.

Heating systems, such as furnaces, include one or more burners for combusting a fuel such as natural gas to name one example. Hot flue gas from the combustion of the fuel proceeds from the burner and through a heat exchanger. The hot flue gas transfers thermal energy to the heat exchanger, from which the thermal energy is then dissipated by a flow of air driven across the heat exchanger by, for example, a blower.

A typical prior art construction of a burner is shown in FIG. 1. A burner 10 is located external to a heat exchanger 12. The burner 10, often referred to as an inshot burner 10, receives a flow of fuel from a fuel source 14. An ignition source 16 combusts the flow of fuel to create a combustion flame 18.

Another type of burner is a premix burner in which fuel and air are mixed in a burner inlet tube prior to injection into a combustion zone 19 where the ignition source 16 ignites the mixture. Premix burners, compared to inshot burners, typically emit lower levels of nitrogen oxides ($NO_x$), the emissions of which are tightly regulated and restricted by many jurisdictions. Because of this advantage of premix burners, it may be desirable to utilize premix burners in heating systems.

BRIEF DESCRIPTION

According to one aspect of the invention, a burner assembly for providing a flame and combustion gas to a plurality of inlets includes a burner frame having a channel formed therein. The channel extends parallel to a longitudinal plane defined by the plurality of inlets. A burner is mounted within the channel of the burner frame. The burner is arranged in fluid communication with the plurality of inlets. A burner bracket is used to mount the burner assembly within a burner box. The burner bracket defines a cavity within which the channel of the burner frame and the burner are positionable.

In addition to one or more of the features described above, or as an alternative, in further embodiments comprising at least one gasket to thermally isolate the burner frame from the burner bracket.

In addition to one or more of the features described above, or as an alternative, in further embodiments the burner frame further comprises a first member and a second member, the first member extending within a plane and the second member defining the channel, wherein the second member is oriented substantially perpendicular to the first member.

In addition to one or more of the features described above, or as an alternative, in further embodiments the burner bracket includes an opening and the first member is coupled to an adjacent surface of the burner bracket such that the second member and the burner extend through the opening into the cavity.

In addition to one or more of the features described above, or as an alternative, in further embodiments the burner is mounted adjacent a distal end of the channel.

In addition to one or more of the features described above, or as an alternative, in further embodiments comprising a refractory panel including at least one refractory opening, the refractory panel being receivable within the cavity of the burner bracket.

In addition to one or more of the features described above, or as an alternative, in further embodiments the refractory panel overlies a portion of the burner frame and the burner.

In addition to one or more of the features described above, or as an alternative, in further embodiments the refractory panel includes a plurality of elongated channels receivable within the plurality of inlets.

In addition to one or more of the features described above, or as an alternative, in further embodiments a length of the plurality of elongated channels is greater than a diameter of the plurality of elongated channels.

In addition to one or more of the features described above, or as an alternative, in further embodiments a front planar surface of the refractory panel is substantially flush with an end of the burner bracket.

In addition to one or more of the features described above, or as an alternative, in further embodiments a gasket is positioned between an exterior of the burner bracket and the burner box.

In addition to one or more of the features described above, or as an alternative, in further embodiments an interior surface of the burner is contoured to direct flames from the interior surface to a focus.

In addition to one or more of the features described above, or as an alternative, in further embodiments the interior surface of the burner is elliptical in shape.

In addition to one or more of the features described above, or as an alternative, in further embodiments the interior surface of the burner is circular in shape.

In addition to one or more of the features described above, or as an alternative, in further embodiments the burner has at least one dimple formed therein.

According to another embodiment, a furnace includes a heat exchanger having a heat exchanger coil providing a conduit of combustion gasses having an inlet and an outlet. A burner assembly is adapted to direct a flame into the inlet of the heat exchanger coil. The burner assembly includes a burner frame having a channel formed therein. The channel extends parallel to a longitudinal plane defined by the inlet. A burner is mounted within the channel of the burner frame and is arranged in fluid communication with the inlet. A burner bracket mounts the burner assembly within a burner box. The burner bracket defines a cavity within which the channel of the burner frame and the burner are positionable.

In addition to one or more of the features described above, or as an alternative, in further embodiments the heat exchanger includes a plurality of heat exchanger coils, each of the plurality of heat exchanger coils including an inlet and an outlet.

In addition to one or more of the features described above, or as an alternative, in further embodiments the burner is arranged in fluid communication with the inlet of the plurality of heat exchanger coils.

According to another embodiment, a burner assembly for providing a flame and combustion gas to a plurality of inlets includes a burner arranged in fluid communication with the plurality of inlets. A refractory panel is positioned between an outlet of the burner and the plurality of inlets. The refractory panel includes a plurality of elongated channels receivable within the plurality of inlets for communicating the flame and combustion gas thereto. A length of the plurality of elongated channels is greater than a diameter of the plurality of elongated channels.

In addition to one or more of the features described above, or as an alternative, in further embodiments an axis of each of the plurality of elongated channels is parallel to an axis of each of the plurality of inlets.

In addition to one or more of the features described above, or as an alternative, in further embodiments each of the plurality of inlets has a zone of greatest heat defined therein and a length of each of the plurality of elongated channels extends over a substantial entirety of the zone of greatest heat.

In addition to one or more of the features described above, or as an alternative, in further embodiments each of the plurality of elongated channels is formed from a rolled sheet metal.

In addition to one or more of the features described above, or as an alternative, in further embodiments each of the plurality of elongated channels is extruded.

In addition to one or more of the features described above, or as an alternative, in further embodiments the refractory panel further comprises a planar surface and the plurality of elongated channels are mounted to the planar surface.

In addition to one or more of the features described above, or as an alternative, in further embodiments each of the plurality of elongated channels is mounted generally perpendicular to the planar surface.

In addition to one or more of the features described above, or as an alternative, in further embodiments the plurality of inlets directly abut the planar surface of the refractory panel.

In addition to one or more of the features described above, or as an alternative, in further embodiments comprising a gasket mounted to the planar surface of the refractory panel.

In addition to one or more of the features described above, or as an alternative, in further embodiments the length of the plurality of elongated channels is at least double the diameter of the plurality of elongated channels.

In addition to one or more of the features described above, or as an alternative, in further embodiments the burner has at least one dimple formed therein.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
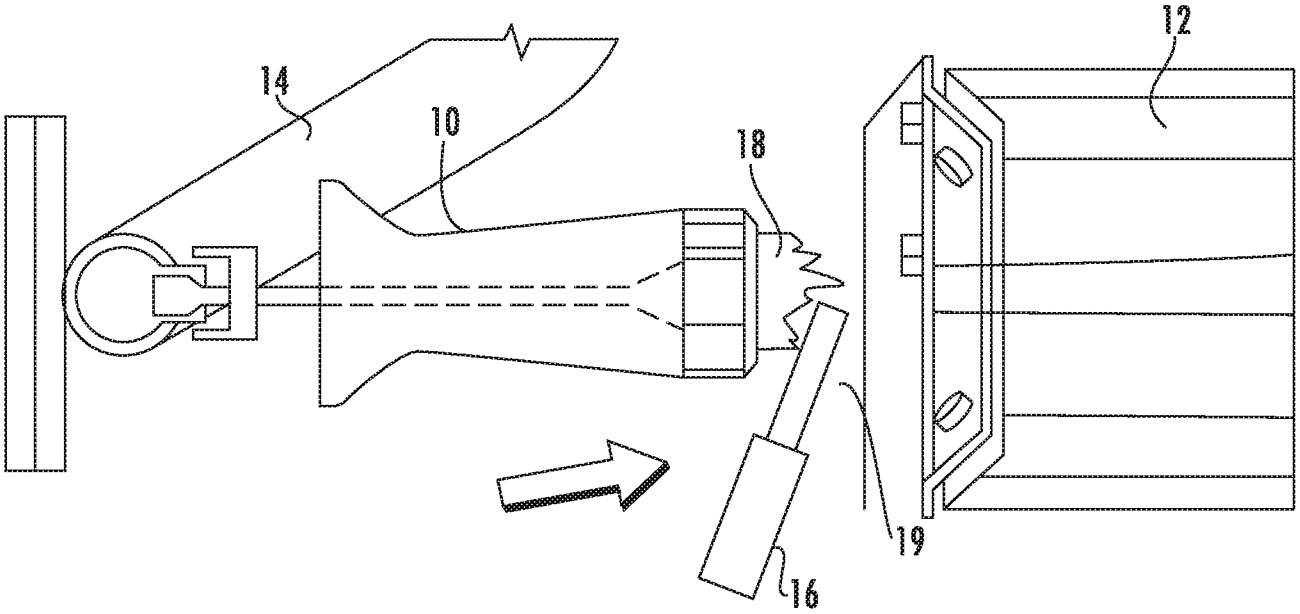
FIG. 1 PRIOR ART
FIG. 1 is a cross-sectional view of an example of a typical prior art burner arrangement.

The detailed description explains embodiments of the invention, together with advantages and features, by way of example with reference to the drawings.

DETAILED DESCRIPTION

Referring now to the FIGS., an improved furnace 20 is illustrated. However, it should be understood that the disclosure is not limited to a furnace, but rather may be adapted for use in any small packaged product. The furnace 20 may include a heat exchanger 22 having a plurality of individual heat exchanger coils 24. The heat exchanger coils 24, which may be metallic conduits, may be provided in a serpentine fashion to provide a large surface area in a small overall volume of space, the importance of which will be discussed in further detail below. Each heat exchanger coil 24 includes an inlet 26 and outlet 28. A burner unit 30 is operatively associated with each inlet 26, and a vent 32 is operatively associated with each outlet 28. The burner unit 30 introduces a flame and combustion gases (not shown) into the heat exchanger coils 24, while vent 32 releases the combustion gases to atmosphere (through a flue or the like) after the heat of the flame and combustion gases is extracted by the heat exchanger 22.

In order to extract the heat, a blower motor 36 may be provided to create a significant air flow across the heat exchanger coils 24. As the air circulates across the coils 24, it is heated and can then be directed to a space to be heated such as a home or commercial building for example, by way of appropriate ductwork as indicated by arrow 37. The furnace 20 may also include a return 38 to enable air from the space to be heated to be recirculated and/or fresh air to be introduced for flow across the heat exchanger coils 24.

Figure 2:
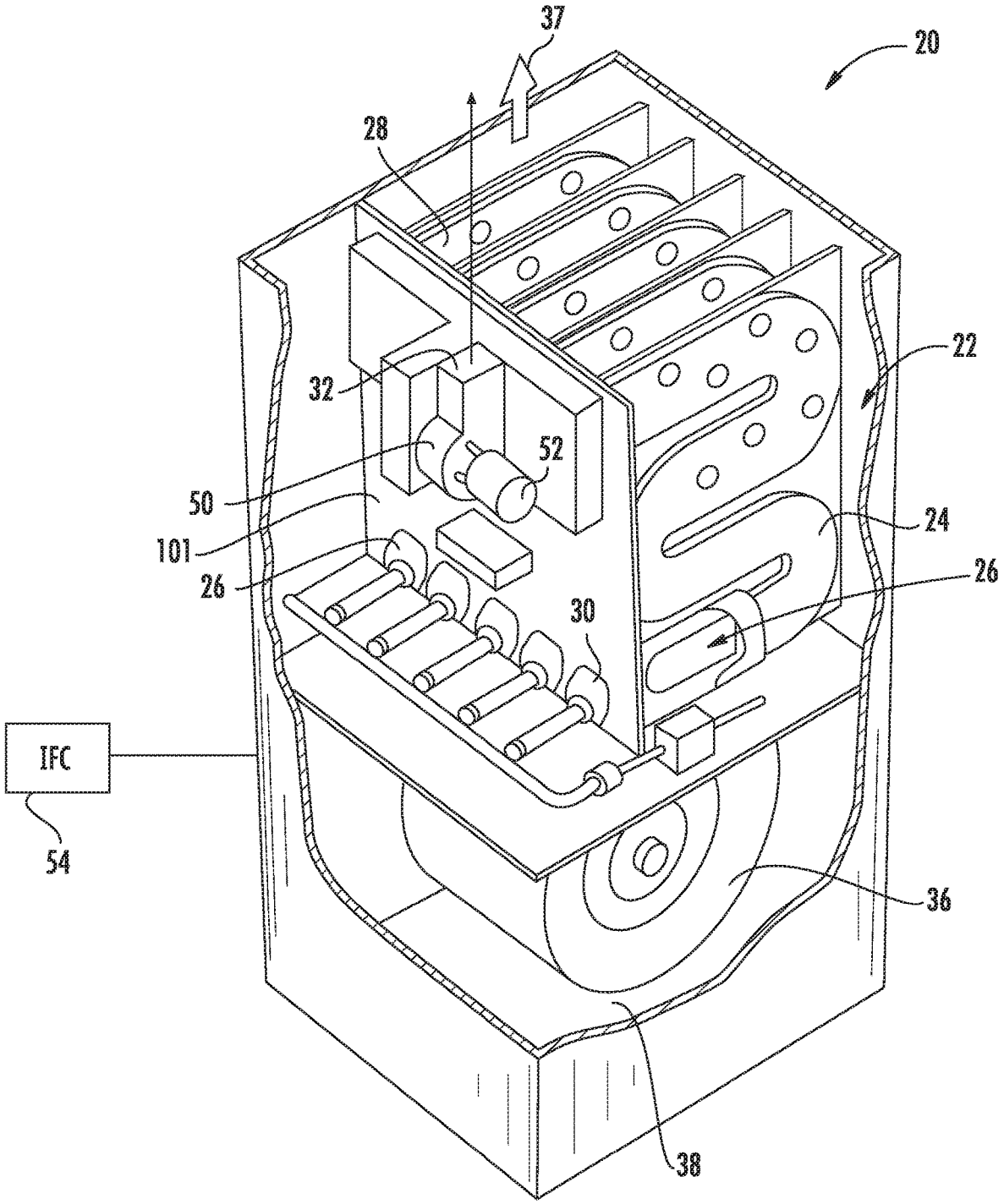
FIG. 2 is a schematic view of an embodiment of a furnace.
Figure 3:
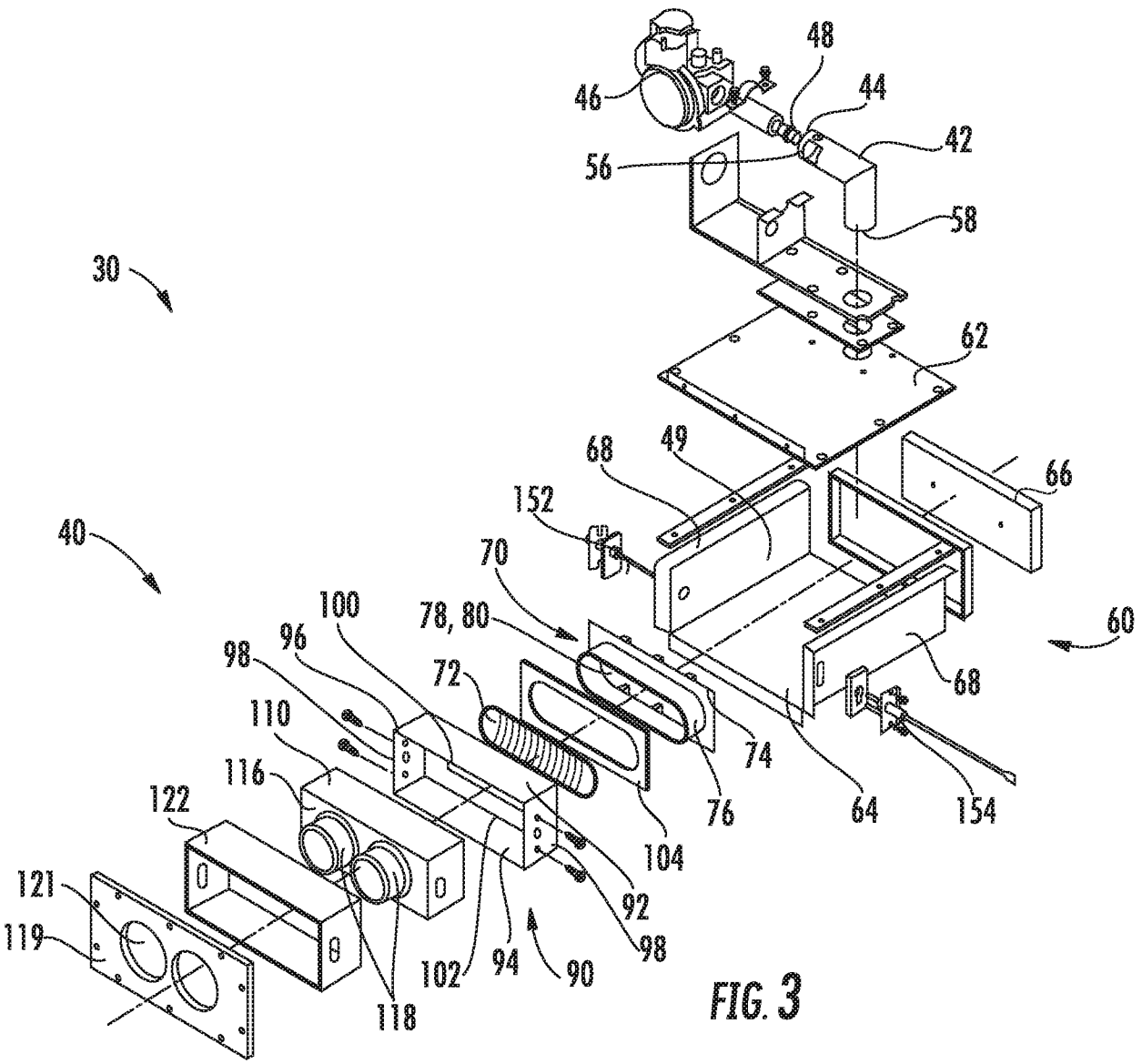
FIG. 3 is an exploded view of a burner assembly according to an embodiment.
Figure 4:
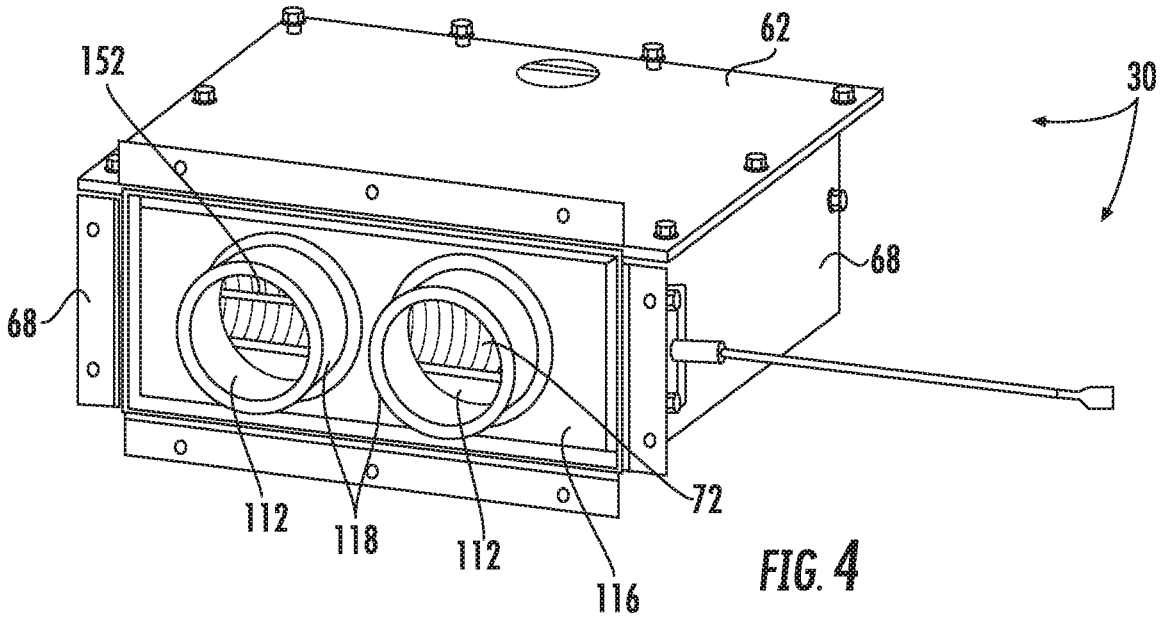
FIG. 4 is a perspective view of a burner assembly according to an embodiment.

Turning to FIG. 3, to generate the flame and hot combustion gases, a mixture of fuel and air is formed and then provided to a burner assembly 40 of the burner unit 30 for ignition. The fuel may be natural gas or propane introduced to an inlet 44 of a mixing tube 42 from a fuel source 46 via a fuel orifice or a jet 48. Substantially all of the air necessary for combustion is introduced into the burner assembly 40 via an upstream mixing chamber 49. Such air may be introduced by inducing an airflow using a motorized induction fan 50 (FIG. 2) downstream of a burner outlet. More specifically, a motor 52 having the fan 50 associated therewith may be operatively associated with the outlets 28 of the heat exchanger coils 24. When energized, the fan 50 may rotate and induce an air flow through the heat exchanger coils 24 and burner unit 30. Control of the motor 52, may be controlled by a processor 54 such as an integrated furnace control (IFC).

Returning to FIG. 3, in an embodiment, one or more openings 56 are formed in the sidewall of the mixing tube 42 generally adjacent the inlet 44. As the fuel moves through the mixing tube 42 towards the mixing chamber 49, air is drawn into the tube 42 through the openings 56 and becomes entrained within the fuel. As a result, the fluid expelled from an outlet 58 of the mixing tube 42 into the mixing chamber 49 is a mixture of both fuel and air.

With specific reference now to FIGS. 3-7, the burner unit 30 is illustrated in more detail. As shown, the burner unit 30 includes a burner box 60 having a generally hollow interior commonly referred to as the mixing chamber 49. The burner box 60 generally includes a top wall 62, bottom wall 64, back wall 66, and opposing sidewalls 68 such that one side of the burner box 60 is open. The burner unit 30 additionally includes a burner assembly 40 mounted within the mixing chamber 49 of the burner box 60.

Figure 5:
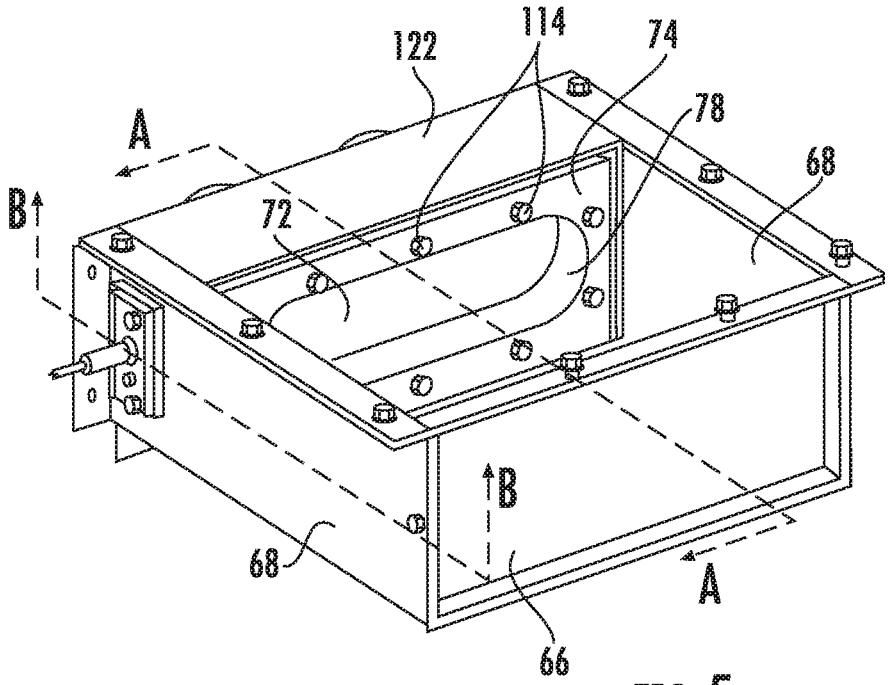
FIG. 5 is another perspective view of a portion burner assembly according to an embodiment.
Figure 6:
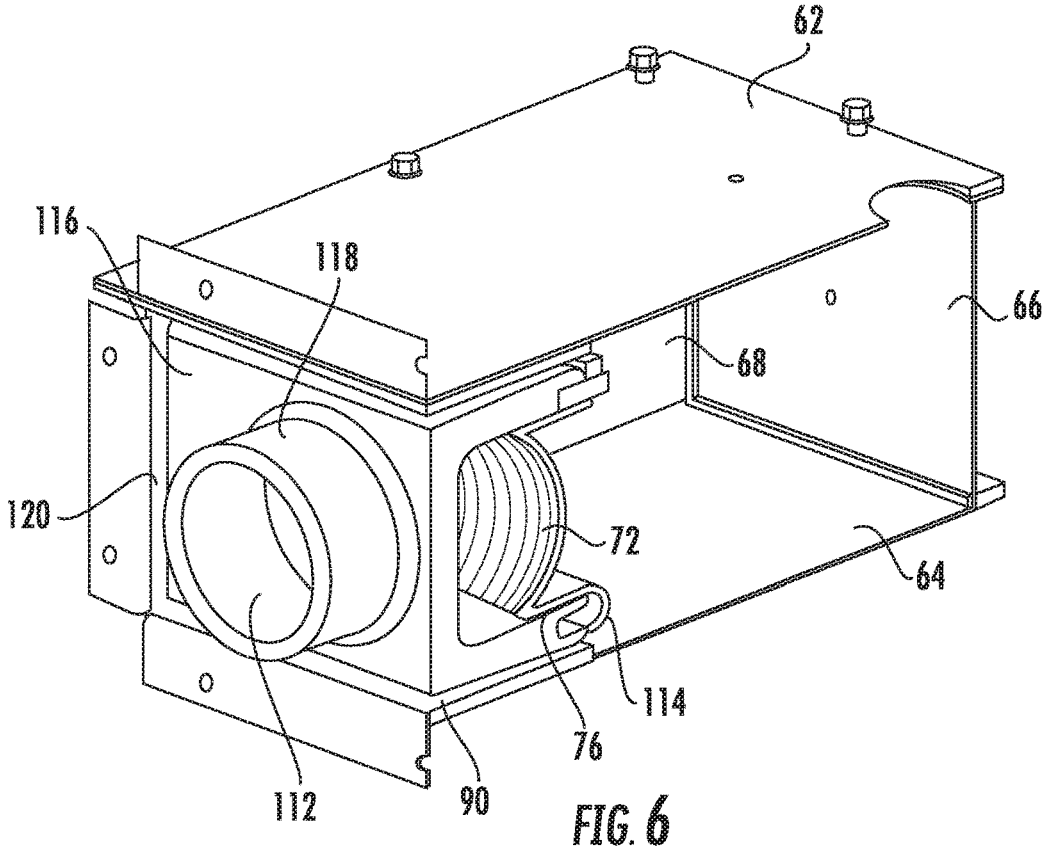
FIG. 6 is a cross-sectional view taken along line A-A according to an embodiment.
Figure 7:
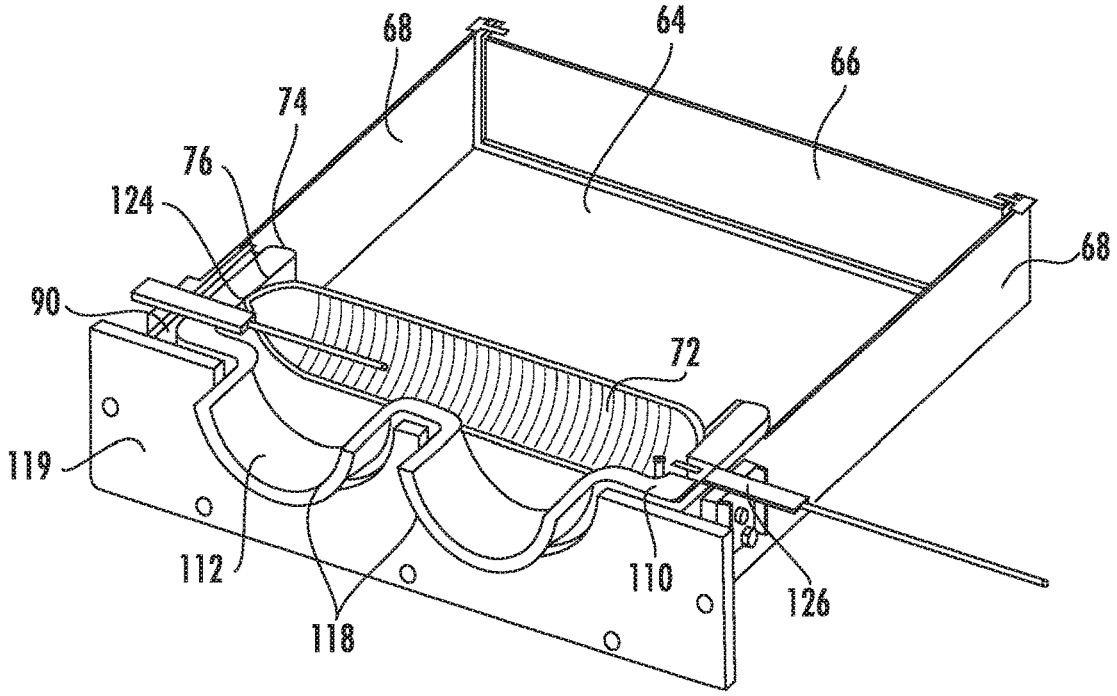
FIG. 7 is a cross-sectional view taken along line B-B according to an embodiment.

The burner assembly 40 includes a burner frame 70 configured to receive a burner 72. The burner frame 70 includes a first member 74 and a second member 76. The first and second members 74, 76 may be coupled together, or alternatively, may be integrally formed. As best shown in FIG. 5, the first member 74 is arranged within and plane and has an opening 78 formed therein. In an embodiment, the opening 78 is generally elongated such that the opening 78 is substantially aligned with the inlet 26 of each of the plurality of heat exchanger coils 24. The second member 76 protrudes from a surface of the first member 74 in a direction toward the heat exchanger coils 24 and substantially perpendicular to the plane of the first member 74. The second member 76 extends about the periphery of the opening 78 to define a channel 80. The channel 80 is oriented generally parallel to a longitudinal plane defined by the plurality of heat exchanger inlets 26. In an embodiment, the opening 78 and channel 80 are oval in shape and the channel 80 has a depth generally equal to or greater than the depth of the burner 72.

Figure 8:
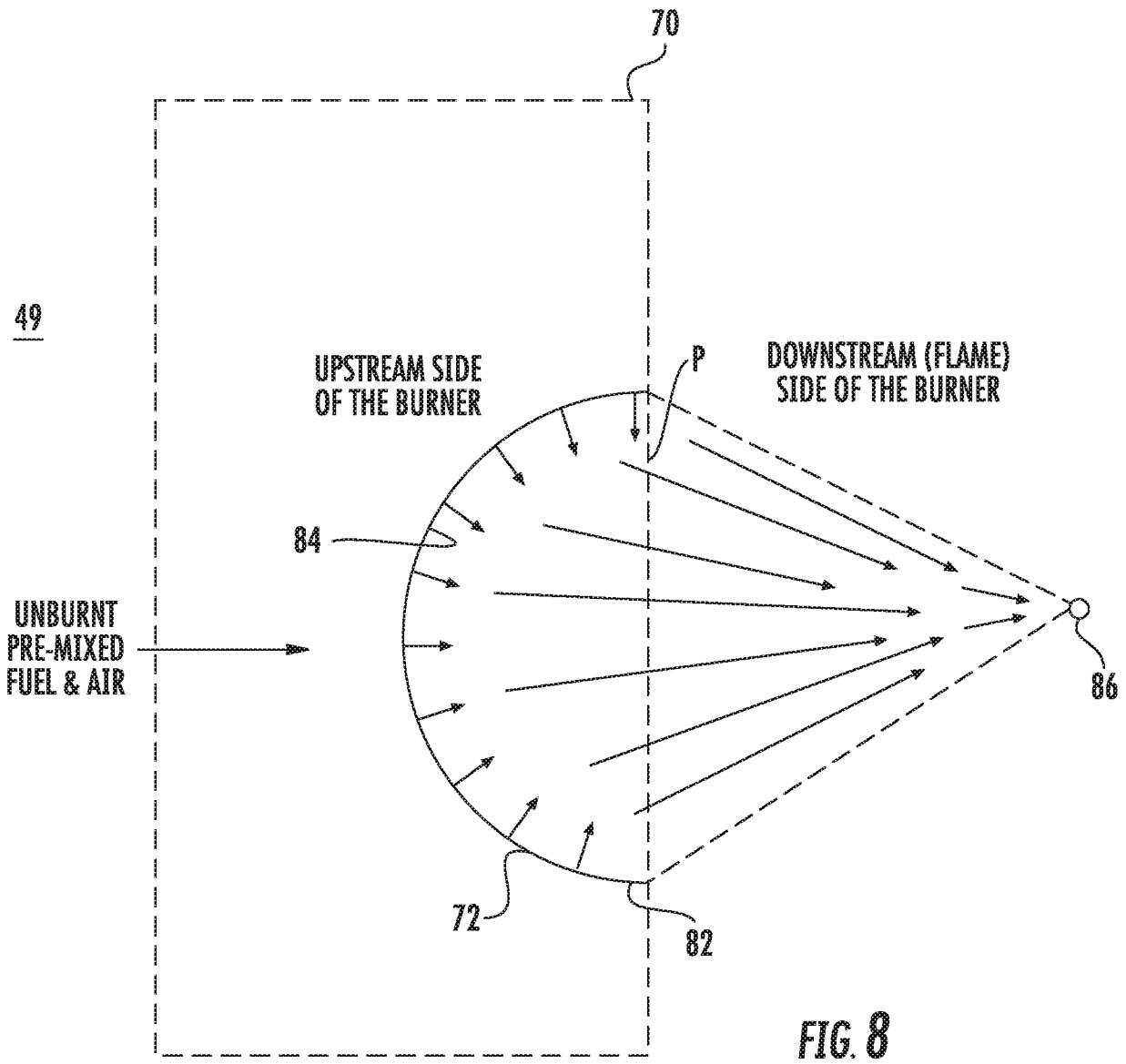
FIG. 8 is a cross-sectional view of a portion of the burner assembly according to an embodiment.

A burner 72 configured to function as a flame retainer is connected to the support member 70 generally adjacent the opening 78. In an embodiment, a first end 82 (shown in FIG. 8) of the burner 72 is coupled to the distal end of the second member 76 of the burner frame 70. As a result, the body of the burner 72 is generally arranged within the channel 80 of the burner frame 70. In an embodiment, the burner 72 is connected to the second member 76, such as via a welding operation for example.

The burner 72 is formed from a porous material, such as a wire mesh or steel wool for example, so that a fluid is able to pass from the mixing chamber 49 through the burner 72. As best shown in the cross-sectional view of FIG. 8, in an embodiment, the burner 72 has a generally tubular contour. The contour of the burner 72 may be selected such that at least a portion of the flames directed from an interior surface 84 of the burner 72 are angled generally inwardly. In an embodiment, the burner 72 has a generally curved shape that directs the plurality of flames formed about the interior surface 84 of the burner 72 towards a central focus 86. For example, the interior surface of the burner 72 is concave, having a generally circular or elliptical shape. In embodiments where the burner 72 has a generally circular or elliptical contour, the focus 86 is located on an opposite side of plane P defined by the first end 82 of the burner 72. By selecting a contour that positions the focus 86 at a position generally aligned with or in front of the plane P, the length of the jet of flames created by the burner 72 exceeds that of flames formed from conventional outward fired burners.

Figure 10:
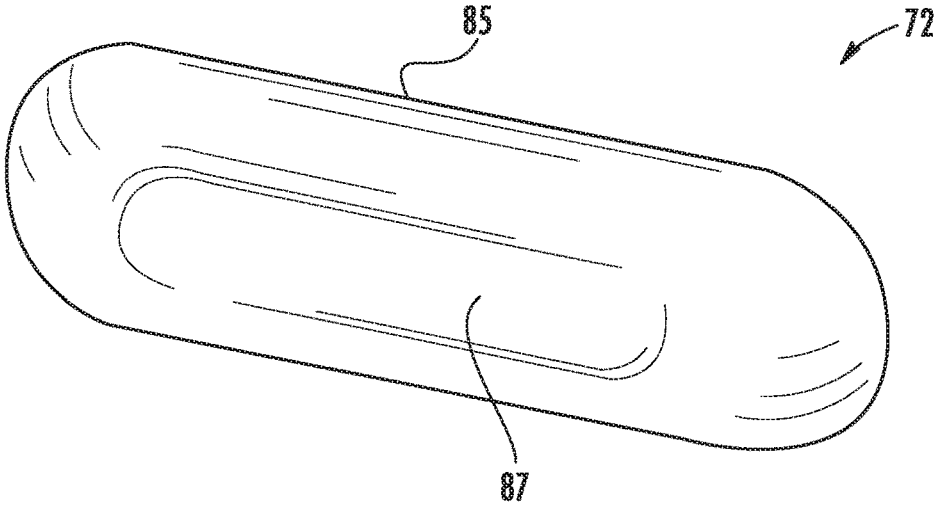
FIG. 10 is a perspective view of a burner according to an embodiment.
Figure 11:
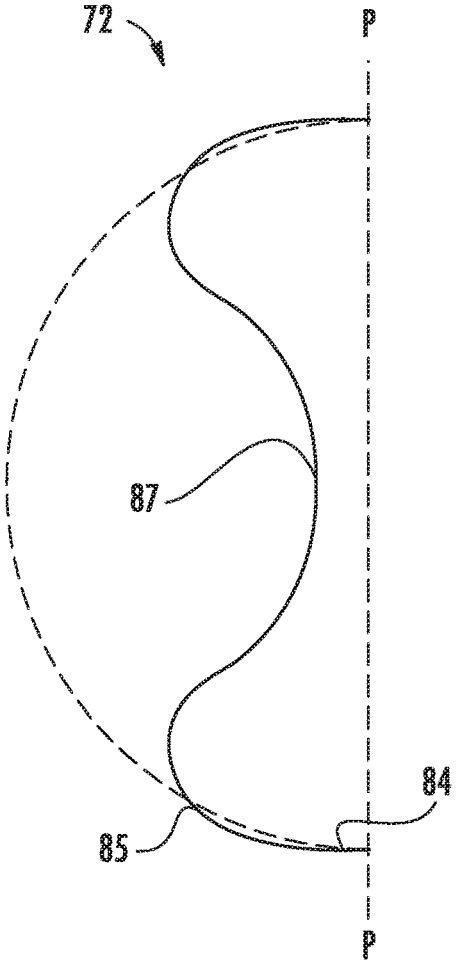
FIG. 11 is a cross-sectional view of the burner of FIG. 10 according to an embodiment.

With reference to FIGS. 10 and 11, in an embodiment, a dimple 87 is formed in a portion of the burner 72. As shown in the FIG., the dimple 87 is generally elongated and extends in a direction parallel to the longitudinal axis defined by the burner 72. The dimple 87 is formed such that the outer surface 85 of the burner 72 is pushed inwardly in a direction towards the focus 86 thereof. As a result, the portion of the inner surface 84 adjacent the dimple 87 may have a convex curvature. However, the radius of curvature associated with the dimple 87 is less than the radius of curvature of the burner 72. The depth of the dimple 87 may be generally equal to the depth of the burner 72 such that the dimple extends to the plane P defined by the first end 82 of the burner 72. Alternatively, the dimple 87 may have a depth equal to only a portion of the depth of the burner 72. Accordingly, the at least one dimple 87 may be formed in burner 72 to reduce the depth of the burner mesh while maintaining the same surface area of the burner mesh. Although only a single dimple is illustrated, embodiments where the burner 72 includes a plurality of similar or different dimples are contemplated herein The burner assembly 40 additionally includes a burner bracket 90 configured to mount the burner assembly 40 within the interior 49 of the burner box 60. In the illustrated, non-limiting embodiment, the burner bracket 90 has a box-like shape including a top wall 92, bottom wall 94, back wall 96, and opposing sidewalls 98 such that one side of the burner bracket 90 is open. However, other configurations of the burner bracket 90 are also contemplated herein. The back wall 96 of the burner bracket 90 includes an opening 100 generally complementary to the second member 76 of the burner frame 70. The surface of the first member 74 of the burner frame 70 is configured to abut the back wall 98 such that the second member 76 and the burner 72 coupled thereto extend through the opening 90 into the cavity 102 defined by the burner bracket 92. In an embodiment, a gasket 104 may be mounted between the surface of the first member 74 and the adjacent surface of the back wall 96 to thermally isolate the burner bracket 90 and burner frame 70.

A refractory panel 110 including at least one refractory opening 112 is aligned with the inlet 26 of one or more heat exchanger coils 24. The refractory panel 110 may be formed from any suitable material could be used, including but not limited to a refractory material and a metal, such as a high temperature metal alloy for example. The refractory panel 110 is configured to protect not only the adjacent surface of the burner bracket 90, but also the interface between the burner frame 70 and the heat exchanger coils 24, from overheating. In the illustrated, non-limiting embodiment, the refractory panel 110 is receivable within the cavity 92 of the burner bracket 90. However, embodiments where the refractory panel 110 is mounted to the burner assembly 40 in another configuration are also contemplated herein. In an embodiment, best shown in FIG. 7, the refractory panel 110 is configured to overlay all or at least a portion of the second member 76 of the burner frame 70. The refractory panel 110 may be fastened to the back wall 96 of the burner bracket 90 and/or to the first member 74 of the burner frame 70 via a plurality of fasteners 114 (see FIGS. 5 and 6).

In the illustrated, non-limiting embodiment, the refractory panel 110 includes a front planar surface 116 and a plurality of channels 118 extending beyond the plane defined by the front planar surface 116. Each channel 146 defines a refractory opening 142 and is associated with one or more of the heat exchanger coils 24. However, embodiments where the refractory panel 110 does not include one or more channels 118 are also contemplated herein. When mounted within the burner bracket 90, the refractory panel 110 is positioned such that the front planar surface 116 is substantially aligned with a first end 120 of the burner bracket 90. As a result, in embodiments where the refractory panel 110 includes one or more channel 118, the channels 118 protrude beyond the burner bracket 90.

Figure 9:
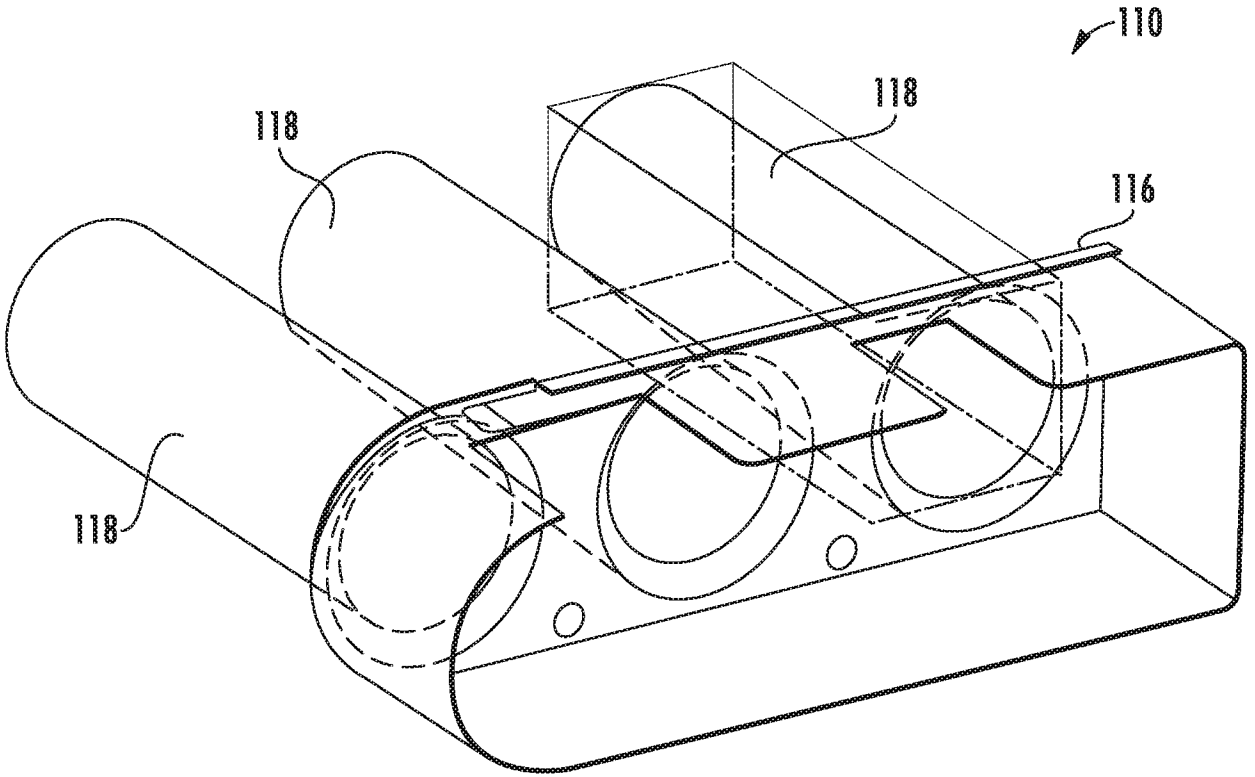
FIG. 9 is a perspective view of a refractory panel of a burner assembly according to an embodiment.

In an embodiment, best shown in FIG. 9, one or more of the channels 118 extending from the planar surface 116 of the refractory panel 110 is received within an inlet of a corresponding heat exchanger coil 24. When the channels 118 are inserted into the heat exchanger coils 24, the inlet end 26 of the coils 24 may directly abut the planar surface 116 of the refractory panel 110. Alternatively, a gasket 119 having at least one opening 121 formed therein may be positioned between the planar surface 116 of the refractory panel 110 and the inlet end 26 of the coils 24. In such embodiments, each of the openings 121 formed in the gasket 119 is substantially aligned with an opening 112 formed in the refractory panel 110 and/or an inlet 26 of a corresponding heat exchanger coil 24.

As shown, the hollow channels 118 may be generally molded sections integrally formed with the main refractory panel 110. The hollow channels 118 are configured to shield against heat inside the burner bracket 90. In an embodiment, a length of the plurality of elongated channels 118 is greater than a diameter of the plurality of elongated channels. However, in other embodiments, the length may be less than the diameter of the elongated channel 118. The temperature within each of the heat exchanger coils 24 varies over the length of the coil 24 and a zone where the coil 24 has the greatest heat is arranged adjacent the inlet 26 of the coils 24. The exact length of such a zone may extend between about 3 inches and about 10 inches, such as about 5 inches for example, depending on the configuration of the heat exchanger 22. In an embodiment, the channels 118 are configured to extend within the heat exchanger tubes 24 over the substantial entirety of the zones of greatest heat. It should be understood that the refractory panel 110 illustrated and described herein may be used in any burner assembly or furnace application.

A gasket 122 may be positioned about the exterior surface of the burner bracket 90, generally between the burner bracket 90 and the adjacent surface of the burner box 60. The gasket 122 is configured to provide a thermal break between the burner assembly 40 and the burner box 60.

With reference again to FIG. 7, an igniter 124 operable to ignite the fuel/air mixture within the burner 72 is located near the open end of the burner 72. In an embodiment, the igniter 124 is mounted about the exterior of the burner box 60 and extends through the burner box 60, the burner bracket 90, and the refractory panel 110. Similarly, a flame sensor 126 configured to determine if the ignition has carried over across the entire opening 78 may be disposed on an opposite side of the burner box 60 from the igniter 124. The flame sensor 126 may similarly extend through the burner box 60, the burner bracket 90, and the refractory panel 110.

A burner unit 30 having an elongated burner 72 as illustrated and described herein provides a system having consistently "smooth" ignitions during both normal and abnormal conditions. By eliminating multiple premix burners, the occurrence of pressure waves which can disrupt the attachment between the flame and the burner at the time of ignition is prevented.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A burner assembly for providing a flame and combustion gas to a plurality of inlets, comprising:

a burner frame having a first member and a second member, the first member having an opening formed therein and the second member protruding from a downstream surface of the first member, the first member extending about a periphery of the opening to form a channel, the channel extending parallel to a longitudinal plane defined by the plurality of inlets;

a burner connected to the second member and arranged within an interior of the channel formed by the second member of the burner frame, the burner being arranged in fluid communication with the plurality of inlets; and a burner bracket for mounting the burner assembly within a burner box, the burner bracket defining a cavity within which the channel of the burner frame and the burner are positionable.

2. The burner assembly of claim 1, further comprising at least one gasket to thermally isolate the burner frame from the burner bracket.

3. The burner assembly of claim 2, wherein the second member is oriented substantially perpendicular to the first member.

4. The burner assembly of claim 1, wherein the burner is mounted adjacent a distal end of the channel.

5. The burner assembly of claim 1, further comprising a refractory panel including at least one refractory opening, the refractory panel being receivable within the cavity of the burner bracket.

6. The burner assembly of claim 5, wherein the refractory panel overlies a portion of the burner frame and the burner.

7. The burner assembly of claim 5, wherein the refractory panel includes a plurality of elongated channels receivable within the plurality of inlets.

8. The burner assembly of claim 5, wherein a front planar surface of the refractory panel is substantially flush with an end of the burner bracket.

9. The burner assembly of claim 1, wherein a gasket is positioned between an exterior of the burner bracket and the burner box.

10. The burner assembly of claim 1, wherein an interior surface of the burner is contoured to direct flames from the interior surface to a focus.

11. The burner assembly of claim 1, wherein the burner has at least one dimple formed therein.

12. A furnace comprising:

a heat exchanger having a heat exchanger coil providing a conduit of combustion gasses having a plurality of inlets and an outlet;

a burner box having an internal mixing chamber; and a burner assembly adapted to direct a flame into the plurality of inlets, the burner assembly including:

a burner frame having a hollow channel formed therein, the channel being arranged upstream from and extending parallel to a longitudinal plane defined by the inlet;

a burner arranged within an interior of the hollow channel of the burner frame, the burner being arranged in fluid communication with each of the plurality of inlets; and a burner bracket for mounting the burner assembly within the mixing chamber of the burner box, the burner bracket defining a cavity within which the channel of the burner frame and the burner are positionable.

13. The furnace of claim 12, wherein the heat exchanger includes a plurality of heat exchanger coils, each of the plurality of heat exchanger coils including an inlet and an outlet.

14. The furnace of claim 13, wherein the burner is arranged in fluid communication with the inlet of the plurality of heat exchanger coils.

15. A burner assembly for providing a flame and combustion gas to a plurality of heat exchanger inlets, comprising:

a burner arranged in fluid communication with each of the plurality of inlets, the burner being formed from a porous material and having a curved contour; and a refractory panel positioned between an outlet of the burner and the plurality of inlets, the refractory panel including a plurality of elongated channels receivable within the plurality of inlets for communicating the flame and combustion gas thereto, each of the plurality of elongated channels being fluidly coupled to the burner, wherein a length of the plurality of elongated channels is greater than a diameter of the plurality of elongated channels.

16. The burner assembly of claim 15, wherein an axis of each of the plurality of elongated channels is parallel to an axis of each of the plurality of inlets.

17. The burner assembly of claim 15, wherein each of the plurality of inlets has a zone of greatest heat defined therein and a length of each of the plurality of elongated channels extends over a substantial entirety of the zone of greatest heat.

18. The burner assembly of claim 15, wherein the refractory panel further comprises a planar surface and the plurality of elongated channels are mounted to the planar surface.

19. The burner assembly of claim 15, wherein the length of the plurality of elongated channels is at least double the diameter of the plurality of elongated channels.

20. The burner assembly of claim 15, wherein the burner has at least one dimple formed therein.

* * * * *